US007631446B1

(12) United States Patent
Davis

(10) Patent No.: US 7,631,446 B1
(45) Date of Patent: Dec. 15, 2009

(54) CONSTRUCTION BUCKET

(75) Inventor: Richard D. Davis, Absarokee, MT (US)

(73) Assignee: Davis and Sons Const. LLC, Absarokee, MT (US)

( * ) Notice: Subject to any disclaimer, the term of this patent is extended or adjusted under 35 U.S.C. 154(b) by 0 days.

(21) Appl. No.: 12/324,823

(22) Filed: Nov. 26, 2008

(51) Int. Cl.
*E02F 3/40* (2006.01)

(52) U.S. Cl. ..... 37/444

(58) Field of Classification Search ..... 37/403–410, 37/444, 302, 903; 414/722–724, 912; 172/815, 172/817, 787, 786, 791, 195–199, 684.5
See application file for complete search history.

(56) References Cited

U.S. PATENT DOCUMENTS

| | | | | |
|---|---|---|---|---|
| 4,815,542 A | | 3/1989 | DePlazes | |
| 5,515,625 A | | 5/1996 | Keigley | |
| 5,564,885 A | * | 10/1996 | Staben, Jr. | 414/724 |
| 5,839,212 A | * | 11/1998 | Brinker | 37/416 |
| 5,940,996 A | * | 8/1999 | Cummings | 37/409 |
| 6,182,385 B1 | | 2/2001 | Knutson | |
| 6,470,604 B1 | * | 10/2002 | Foster et al. | 37/267 |
| 6,526,678 B2 | | 3/2003 | Waddington, Jr. | |
| 6,589,007 B2 | | 7/2003 | Burton | |
| 6,718,662 B1 | | 4/2004 | Schaff | |
| 6,913,086 B2 | | 7/2005 | Stevens | |
| 2002/0028126 A1 | | 3/2002 | Ihm | |
| 2002/0044862 A1 | | 4/2002 | Burton | |
| 2004/0040725 A1 | | 3/2004 | Stevens | |

* cited by examiner

*Primary Examiner*—Robert E Pezzuto
(74) *Attorney, Agent, or Firm*—Antoinette M. Tease

(57) ABSTRACT

A construction bucket comprising a rear wall, two side walls, a bottom plate, and two side arms. Each side arm comprises a first hydraulic cylinder, a metal tube and an extension. The extension fits into the metal tube, and each side arm is positioned directly on top of one of the two side walls. An elongated blade that is attached to the extension of each side arm, and the first hydraulic cylinders extend and retract the extension within the metal tube, thereby causing the elongated blade to extend and retract. The present invention further comprises two second hydraulic cylinders, which cause the elongated blade to be raised or lowered in relation to the front edge of the bottom plate of the construction bucket.

5 Claims, 13 Drawing Sheets

CONSTRUCTION BUCKET

BACKGROUND OF THE INVENTION

1. Field of the Invention

The present invention relates generally to the field of construction equipment, and more specifically, to a construction bucket that can be used with skid loaders, backhoes, mini payloaders, compact farm tractors, and any other piece of construction or agricultural equipment in which a bucket is used to perform grading and/or digging. The construction bucket can also be used as a grapple attachment.

2. Description of the Related Art

A number of innovations have been developed relating to construction buckets and/or attachments for use therewith, but none of these devices incorporates the features and advantages of the present invention. Several examples of existing devices are discussed below.

U.S. Pat. No. 4,815,542 (DePlazes, 1989) involves an attachment for a box-scraper. The attachment comprises a flat, elongate plate with one or two flanges that is situated directly behind the scraper blade of the box-scraper. The flat plate bears on the ground and facilitates leveling of the ground. The device is designed so that the attachment self-aligns to the leading edge of the scraper blade when the tractor is in motion.

U.S. Pat. No. 5,515,625 (Keigley, 1996) describes a rake attachment for use on a skid steer. The rake attachment comprises an elongated tined or toothed rake blade connected to a frame. The frame of the rake attachment is attached to the skid steer via a mounting saddle. The rake attachment does not extend and retract as in the present invention.

U.S. Pat. No. 6,182,385 (Knutson, 2001) describes a rock and material loading system comprising a shaft with a plurality of teeth that are used to lift rocks and similar materials into a loader bucket. The teeth are preferably tapered and have narrow ends at their distal portions (like a fork). To operate the invention, the user approaches a rock with the teeth in a horizontal position and moves the tractor (or similar equipment) forward until the rock is elevated upon the teeth. The user then actuates hydraulics that cause the teeth to rotate upward, dumping the rock into the bucket.

U.S. Pat. Nos. 6,357,993 (Burton, 2002) and 6,589,007 (Burton, 2003) disclose a ski-steer loader implement or bucket with a hydraulically actuated grapple component. In one embodiment, the grapple component is comprised of a plurality of forwardly and downwardly curbed hooks interconnected by lateral cross bars. In an alternate embodiment, the grapple component is comprised of a pair of hydraulically actuated grapple tooth components. Neither of these embodiments incorporates a forward extension feature.

U.S. Pat. No. 6,526,678 (Waddington, Jr., 2003) provides an improved grapple bucket with two "demo-dozer" attachments, each of which comprises an upper plate and a lower plate. The upper plates are welded to the forks of a standard grapple bucket. Each demo-dozer attachment can be operated independently of the other. The main function of the demo-dozer attachments is to provide added surface area across the entire lip of the bucket, thereby allowing the grapple bucket to hold small objects in addition to large ones. With the grapples fully closed, the demo-dozer attachments can be used to move earth, clear debris, or make a shallow cut in the ground.

U.S. Pat. No. 6,572,324 (Ihm, 2003) involves a hydraulic system for extending and retracting frontal accessories to loading buckets. A hydraulic cylinder is located centrally within the loading bucket and oriented parallel with the front edge of the loading bucket (i.e., extending left to right). This hydraulic cylinder extends and retracts the front accessories (e.g., spears or a scraper) via an intermediate linkage system located just behind the frontal accessory. The intermediate linkage system is connected to a fixed frame that is also parallel to the front edge of the loading bucket. The fixed frame is located within the loading bucket itself and attached to the bottom of the bucket. An overlying cover is preferably placed on top of the fixed frame and intermediate linkage system to keep the load separate from the invention's parts. Because the fixed frame, intermediate linkage system and hydraulic cylinder are all located within the bucket, the capacity of the bucket is greatly diminished.

U.S. Pat. No. 6,718,662 (Schaff, 2004) provides yet another rake-tooth bucket extension attachment in which a plurality of teeth are supported by a frame that attaches to the bucket of a front end loader. The rake attachment is fixed in relation to the bucket.

U.S. Pat. No. 6,913,086 (Stevens 2005) discloses a "skimmer" used to separate the top layer of soil to a desired depth and then remove it. The skimmer comprises a shearing blade and a pushing blade. The shearing blade has front and rear cutting edges and can be raised and lowered, as desired, for purposes of removing a top layer of soil. The pushing blade is positioned in front of the shearing blade and is used to push the sheared soil layer off the new surface, clearing it for further landscaping operations. When the pushing blade is in an operational position, the shearing blade is in a non-operational position, and vice versa.

BRIEF SUMMARY OF THE INVENTION

The present invention is a construction bucket comprising a rear wall; two side walls; a bottom plate comprising a front edge; two side arms, each side arm comprising a first hydraulic cylinder, a metal tube and an extension, wherein the extension fits into the metal tube, and wherein each side arm is positioned directly on top of one of the two side walls; and an elongated blade that is attached to the extension of each side arm; wherein the first hydraulic cylinders extend and retract the extension within the metal tube, thereby causing the elongated blade to extend and retract.

In a preferred embodiment, the present invention further comprises two second hydraulic cylinders; wherein each side arm comprises two brackets that lie on either side of the metal tube; wherein the brackets on either side of the metal tube are pivotally attached to one of the two side walls to form a pivot point; and wherein each second hydraulic cylinder is situated behind the rear wall and is connected to the two brackets that lie on either side of the metal tube such that when the second hydraulic cylinder extends and retracts, the side arm pivots at the pivot point, thereby causing the elongated blade to be raised or lowered in relation to the front edge of the bottom plate of the construction bucket.

In a preferred embodiment, the elongated blade has a height, and the height of the elongated blade is such that when the side arms are fully lowered in relation to the front edge of the bottom plate of the construction bucket, the elongated blade extends beneath the bottom plate.

In a preferred embodiment, the present invention further comprises two cushion valves, wherein each cushion valve is located behind the rear wall adjacent to one of the second hydraulic cylinders, wherein hydraulic hoses for the first and second hydraulic cylinders emanate from the two cushion valves, and wherein the cushion valves provide a cushioning effect for the first and second hydraulic cylinders.

In a preferred embodiment, the present invention further comprising a rock rake attachment; wherein the rock rake attachment comprises a lateral beam, a plurality of vertical teeth, and two insertion members that extend perpendicularly from the lateral beam; and wherein to fit the rock rake attachment onto the bucket, the two insertion members of the rock rake attachment are inserted into the extensions of the side arms and bolted in place.

| REFERENCE NUMBERS | |
|---|---|
| 1 | Skid loader (prior art) |
| 2 | Bucket |
| 3 | Rear wall |
| 4 | Side wall |
| 5 | Bottom plate |
| 6 | Side arm |
| 7 | Bracket |
| 8 | Metal tube |
| 9 | Extension piece |
| 10 | First hydraulic cylinder |
| 11 | Elongated blade |
| 12 | Rear plate (of elongated blade) |
| 13 | Front blade (of elongated blade) |
| 14 | End plate |
| 15 | Third hydraulic cylinder |
| 16 | Fourth hydraulic cylinder |
| 17 | Mounting bracket |
| 18 | Shaft |
| 19 | Hydraulic hose (to first hydraulic cylinder) |
| 20 | Cushion valve |
| 21 | Hydraulic hose (to second hydraulic cylinder) |
| 22 | Pivot point |
| 23 | Rock rake attachment |
| 24 | Lateral beam |

-continued

| REFERENCE NUMBERS | |
|---|---|
| 25 | Teeth |
| 26 | Insertion member |
| 27 | Bolt |

DETAILED DESCRIPTION OF INVENTION

Figure 1:
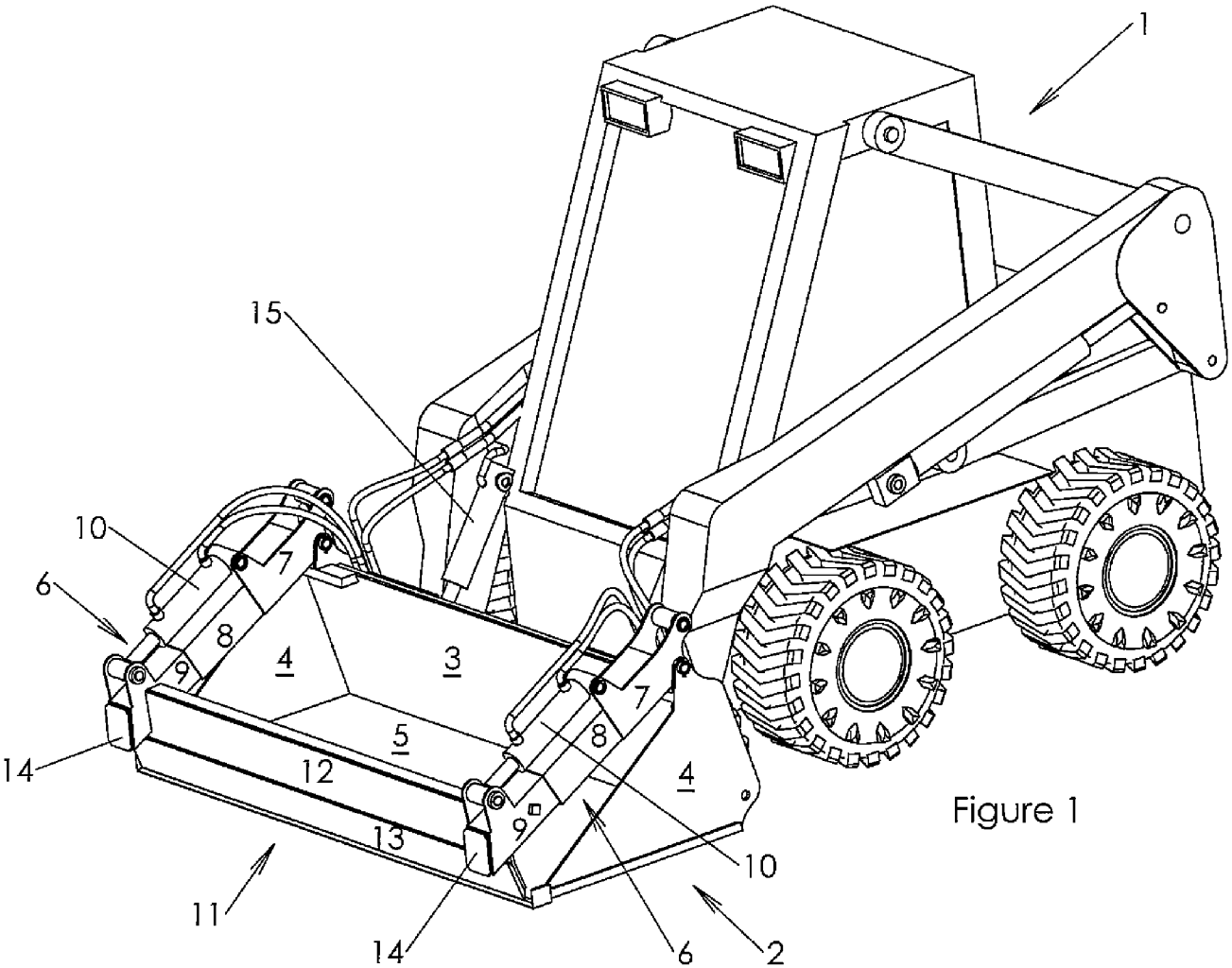
FIG. 1 is a perspective view of the present invention installed on the front of a skid loader.

FIG. 1 is a perspective view of the present invention installed on the front of a skid loader. The skid loader 1 shown in this figure is a New Holland LS 180; however, the present invention can be used with any skid loader, backhoe, mini payloader, compact farm tractor, or any other piece of construction or agricultural equipment in which a bucket is used to perform grading and/or digging or with which a grapple attachment is used. The present invention comprises a bucket 2 that attaches to the skid loader 1 via mounting plates (not shown). The method of attaching the present invention to the skid loader (or similar piece of equipment) is identical to the method of attaching a prior art construction bucket; therefore, the present invention can be used with existing equipment and does not necessitate any special mounting parts.

The bucket itself comprises a rear wall 3, two side walls 4, and a bottom plate 5. The present invention further comprises two side arms 6, each of which comprises two metal brackets 7, a metal tube 8, an extension piece 9, and a first hydraulic cylinder 10. Each bracket 7 is pivotally attached to a side wall 4 of the bucket 2. Each bracket 7 is also connected to a second hydraulic cylinder (not shown) located behind the rear wall 3 of the bucket 2. The brackets 7 also serve to hold a first end of the first hydraulic cylinder 10 in place. The metal tube 8 fits in between the brackets 7 and is fixedly attached to the brackets; the extension piece fits inside the metal tube 8. A second end of the first hydraulic cylinder 10 is fixedly attached to the extension piece 9. The first hydraulic cylinder 10 causes the extension piece 9 to extend and retract. An elongated blade 11 is fixedly attached (welded) to both of the extension pieces 9 (one on the right-hand side of the bucket and the other on the left-hand side), such that when the first hydraulic cylinder 10 causes the extension piece 9 to extend or retract, the elongated blade 11 likewise extends or retracts.

Figure 9:
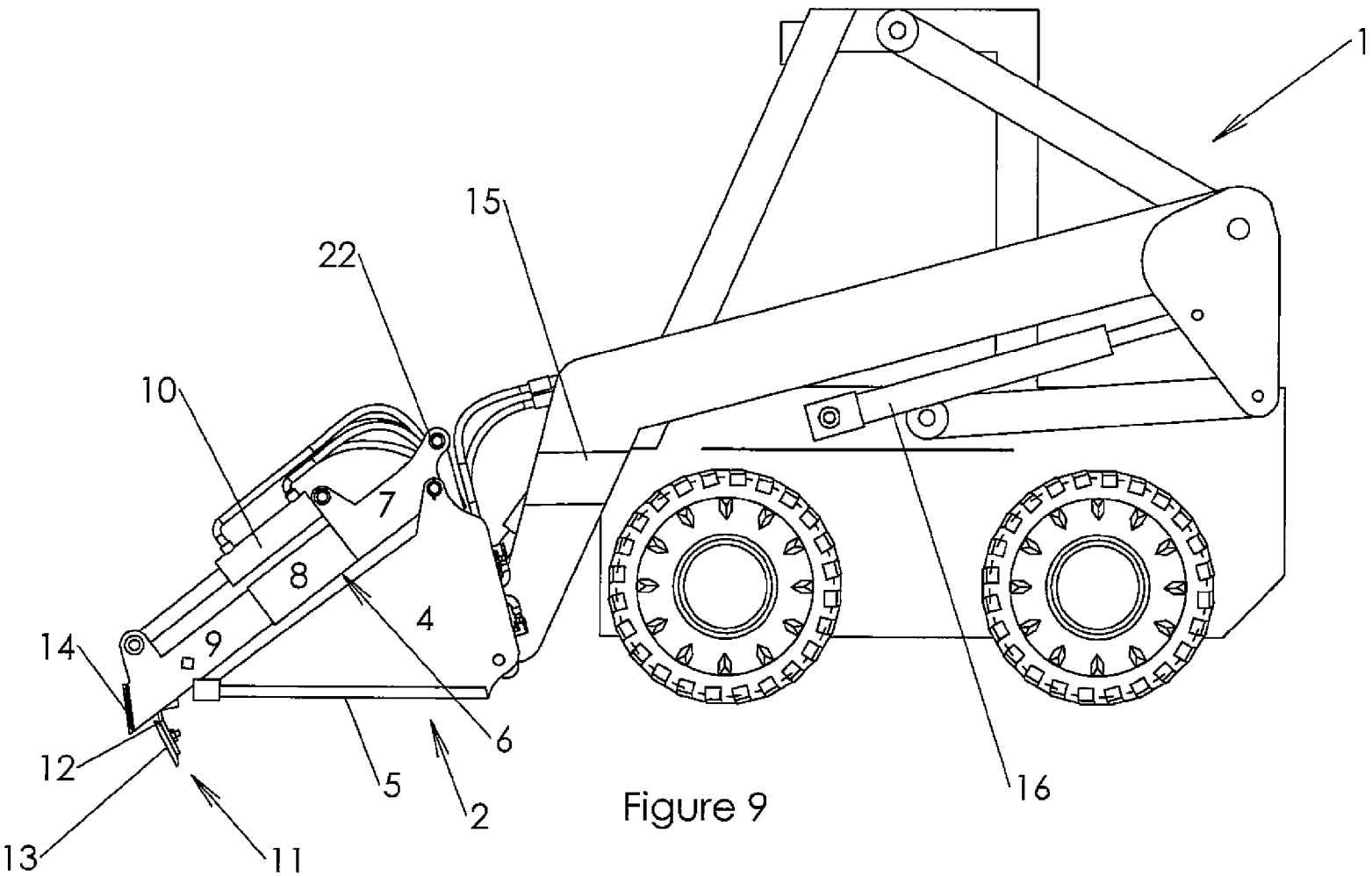
FIG. 9 is a side view of the present invention installed on the front of a skid loader with the elongated blade fully lowered.

In the figures, the elongated blade 11 is shown as two parts, namely, a rear plate 12 with a front blade 13 bolted onto it; however, the elongated blade 11 could be a single piece of metal. The present invention is not limited to the elongated blade 11 being a single part or two parts bolted together. Preferably, the height (i.e., top to bottom) of the elongated blade 11 is such that when the side arms 6 are fully closed (i.e., fully lowered in relation to the front edge of the bottom plate 5), the elongated blade 11 extends a certain distance beneath the bottom plate 5 of the bucket 2 (as shown in FIG. 9). Removable end plates 14 are used to install the rock rake attachment shown in FIGS. 12 and 13.

Two sets of hydraulic cylinders operate the present invention. The first set 10 causes the elongated blade 11 to extend and retract. The second set (not shown) causes the brackets 7 to pivot upward or downward, thereby opening or closing the elongated blade 11 (see FIG. 7). A third set of hydraulic cylinders 15 tips the bucket, and a fourth set of hydraulic cylinders 16 (see FIG. 3) lifts and lowers the entire bucket. The third and fourth sets of hydraulic cylinders 15, 16 come with the skid loader and are not part of the present invention.

Figure 2:
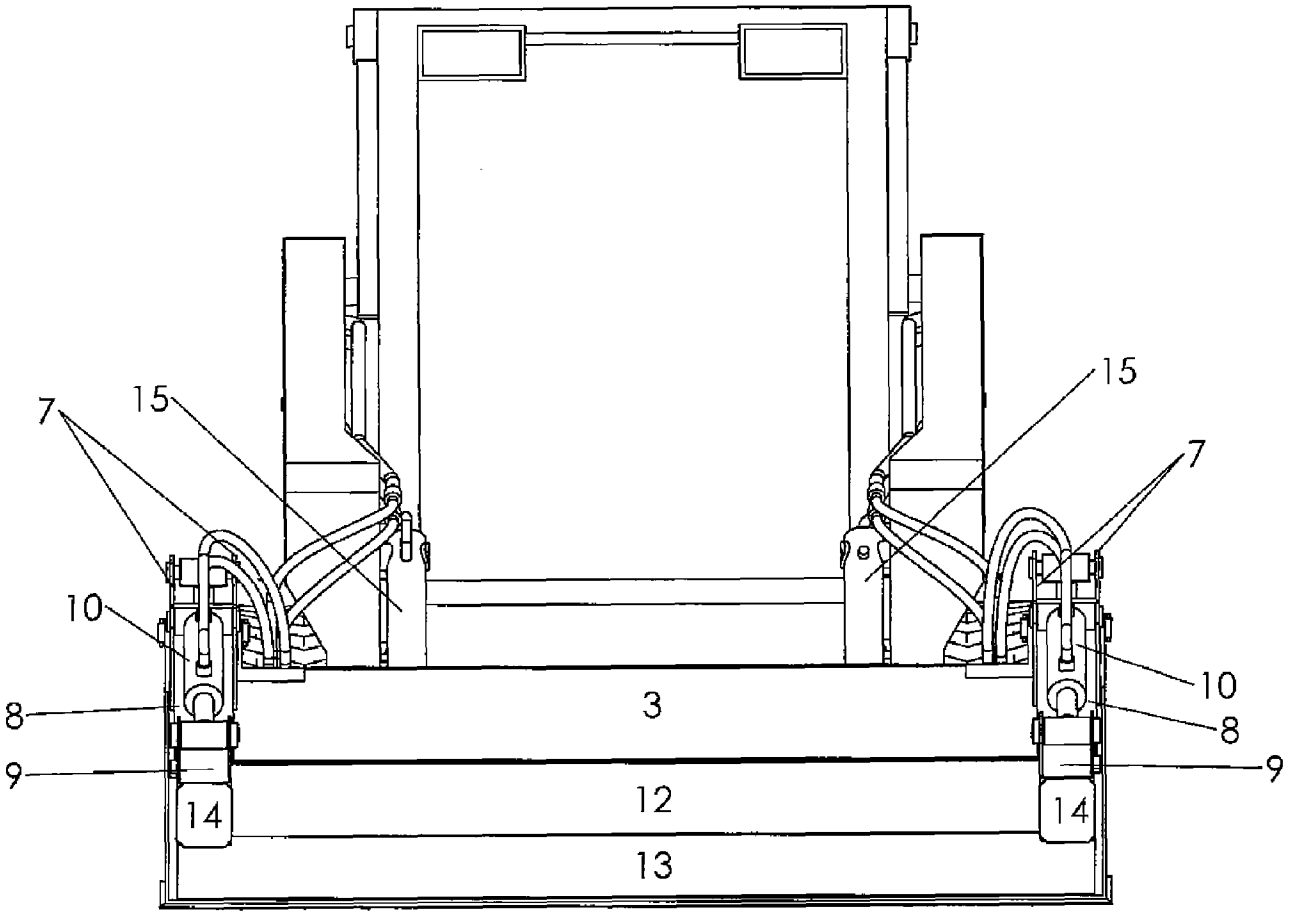
FIG. 2 is a front view of the present invention installed on the front of a skid loader.

FIG. 2 is a front view of the present invention installed on a skid loader. This figure shows the elongated blade 11 in a fully closed position, with the tip of the blade horizontally aligned with the bottom plate 5 (not shown) of the bucket 2. In this position, the elongated blade 11 can be used to contain materials within the bucket 2. It also can be used as a bulldozer, to move earth or other materials as the skid loaders travels forward.

Figure 3:
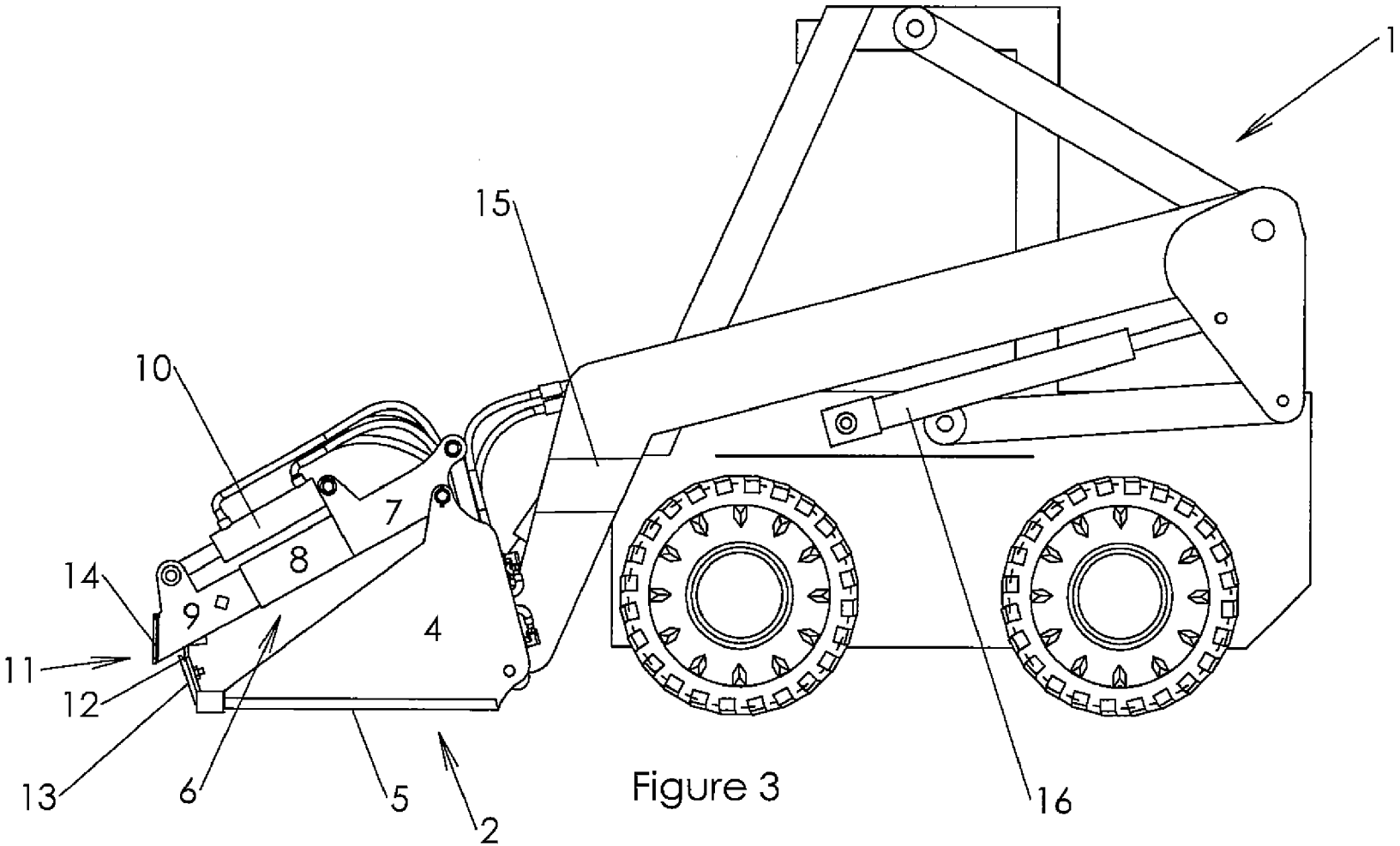
FIG. 3 is a side view of the present invention installed on the front of a skid loader.

FIG. 3 is a side view of the present invention installed on a skid loader. This figure shows the front blade 13 of the elongated blade 11 aligned with the bottom plate 5 of the bucket 2. As shown in subsequent figures, the elongated blade 11 can be extended and/or lifted to provide additional functionality.

Figure 4:
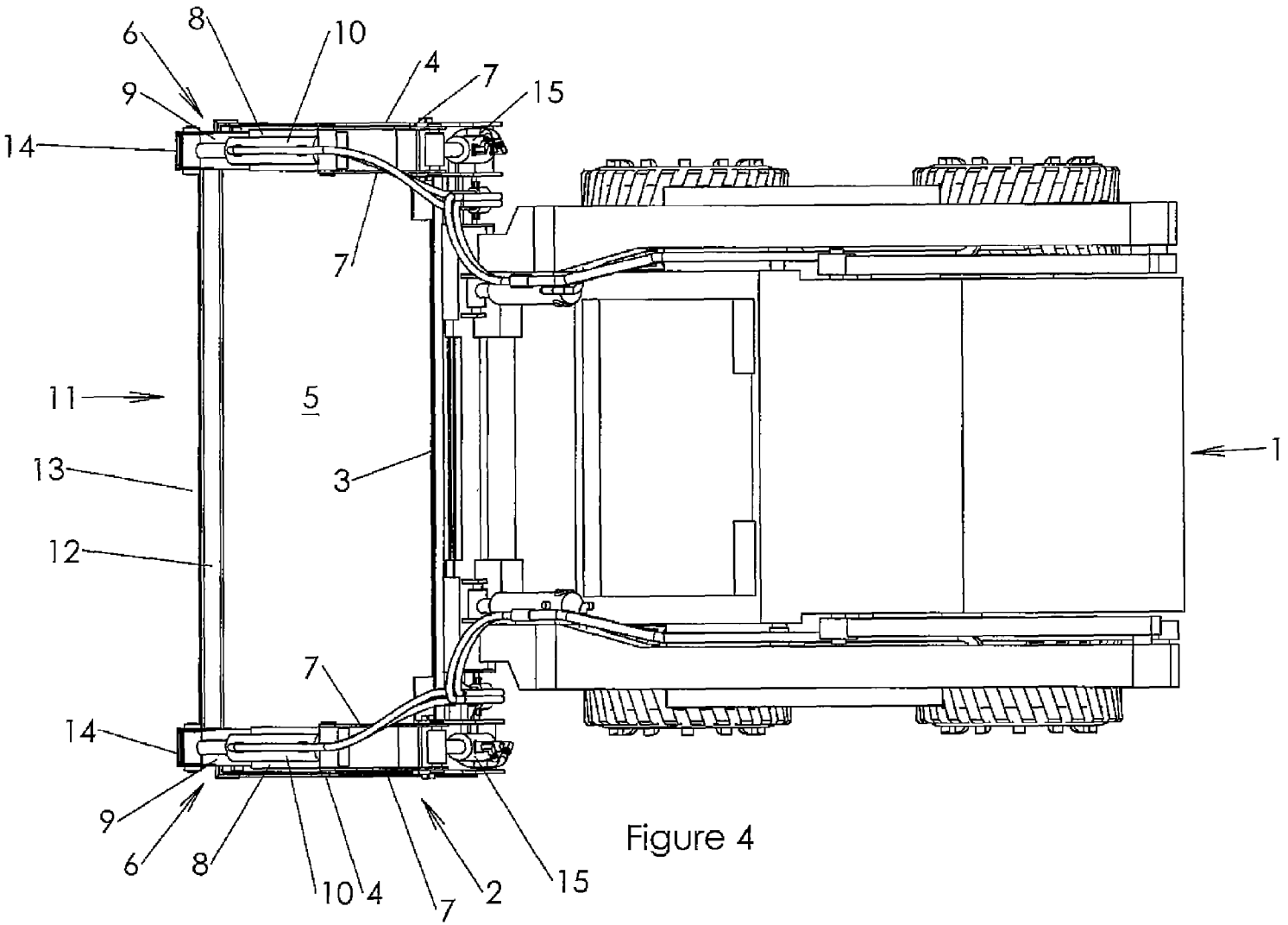
FIG. 4 is a top view of the present invention installed on the front of a skid loader.

FIG. 4 is a top view of the present invention installed on a skid loader. As shown in this figure, contrary to prior art (in particular, U.S. Pat. No. 6,572,324), none of the space inside of the bucket 2 is taken up with hydraulic equipment or frames for operating the hydraulic equipment. With the present invention, the full capacity of the bucket 2 is available for loading.

Figure 5:
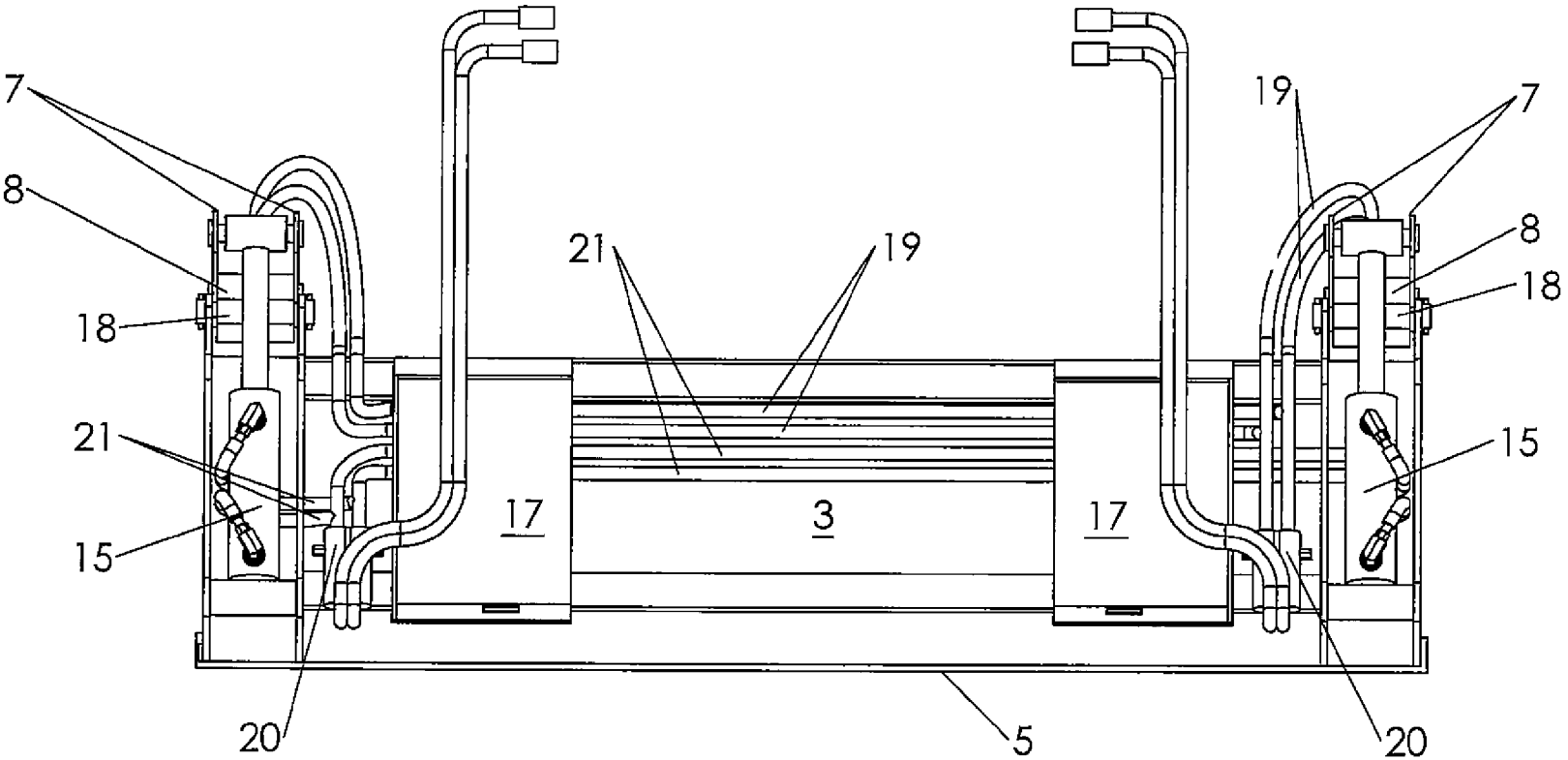
FIG. 5 is a rear view of the present invention unattached to a skid loader.

FIG. 5 is a rear view of the present invention unattached to a skid loader. This figure shows the mounting brackets 17 that are used to mount the bucket 2 to the skid loader 1. The mounting brackets 17 are the same as on prior art construction buckets. Mounting plates (not shown) on the skid loader are inserted into the mountain brackets 17 and bolted into place. This figure also shows the second hydraulic cylinders 15, which cause the side arms 6 to pivot, and the shaft 18 about which the brackets 7 of the side arms 6 pivot.

In one embodiment, the four hydraulic hoses 19 that go to the first hydraulic cylinders 10 emanate from a cushion valve 20 on the left-hand side of the bucket 2, and the four hydraulic hoses 21 that go to the second hydraulic cylinders 15 emanate from a cushion valve 20 on the right-hand side of the bucket 2. The present invention is not limited to any particular configuration of the hydraulic hoses, however. The purpose of the cushion valves is to provide a cushioning effect for the hydraulic pistons.

Figure 6:
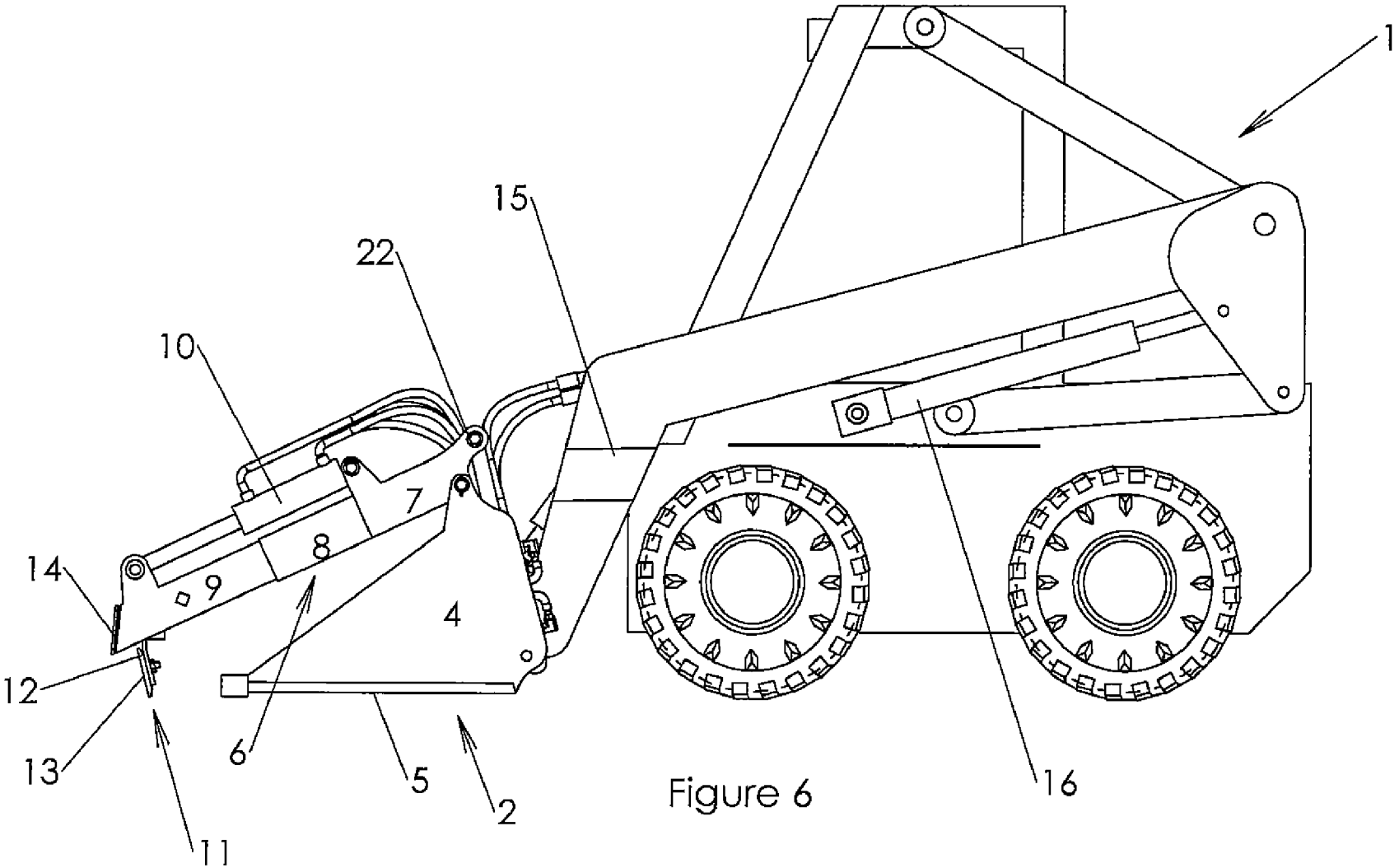
FIG. 6 is a side view of the present invention installed on the front of a skid loader with the elongated blade fully extended.

FIGS. 6-11 further illustrate the present invention in operation. In FIG. 6, the first hydraulic cylinders 10 have been extended, thereby causing the elongated blade 11 to move away from the bucket 2. Conversely, when the first hydraulic cylinders 10 are retracted, the elongated blade 11 will move back into the position shown in FIG. 3. This particular functionality—namely, the ability to extend and retract an elongated blade in front of the bucket without taking up any space within the bucket itself—is not found in prior art. The purpose for extending and retracting the elongated blade 11 is to scoop or sweep material into the bucket 2.

Figure 7:
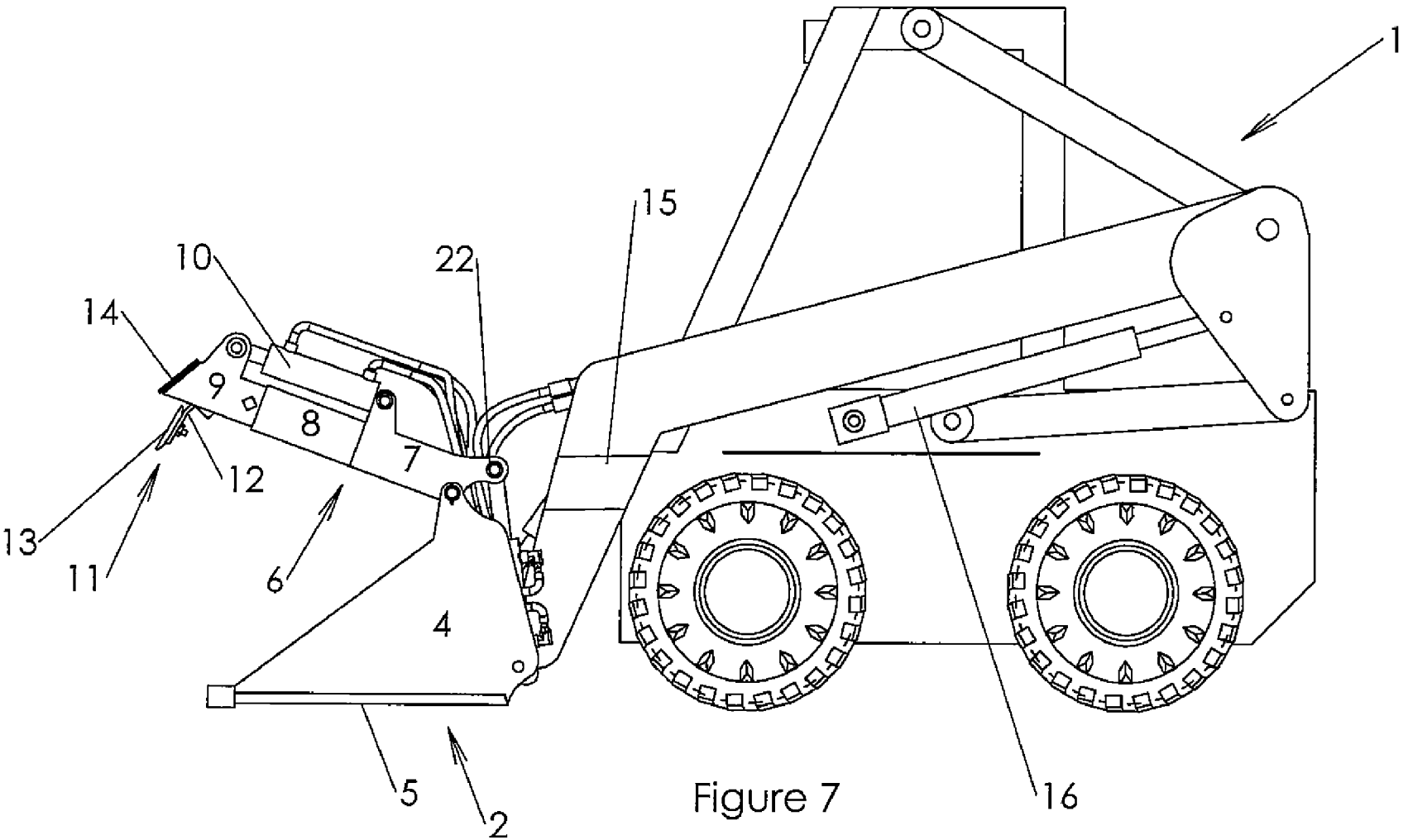
FIG. 7 is a side view of the present invention installed on the front of a skid loader with the elongated blade fully raised.

In FIG. 7, the second hydraulic cylinders 15 have been retracted, thereby causing the side arms 6 to rotate at the pivot point 22. Conversely, when the second hydraulic cylinders 15 are extended, the side arms 6 return to the position shown in FIG. 3. This particular feature allows the present invention to be used as a grapple component, and the elongated blade 11 prevents material from falling out of the bucket when moved back into the position shown in FIG. 3.

Figure 8:
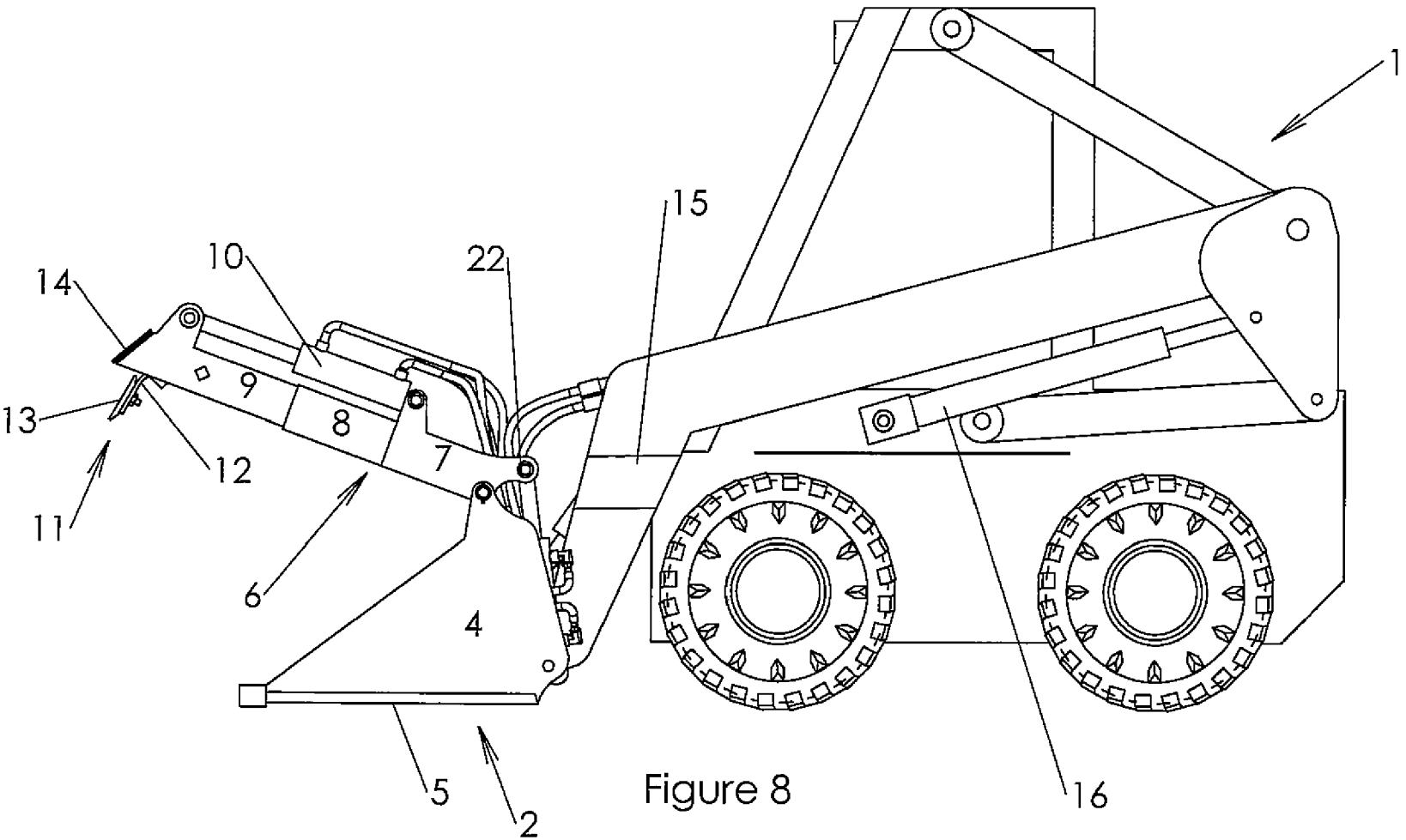
FIG. 8 is a side view of the present invention installed on the front of a skid loader with the elongated blade fully extended and fully raised.

In FIG. 8, the first hydraulic cylinders 10 have been extended, and the second hydraulic cylinders 15 have been retracted. This enables the elongated blade 11 to reach even further to grab debris or other materials and sweep, drag or pull them into the bucket 2.

In FIG. 9, the second hydraulic cylinders 15 have been fully extended so that the elongated blade 11 extends a certain distance beneath the bottom plate 5 of the bucket 2. With the elongated blade 11 in this position, the present invention can be used to dig or grade a level surface.

Figure 10:
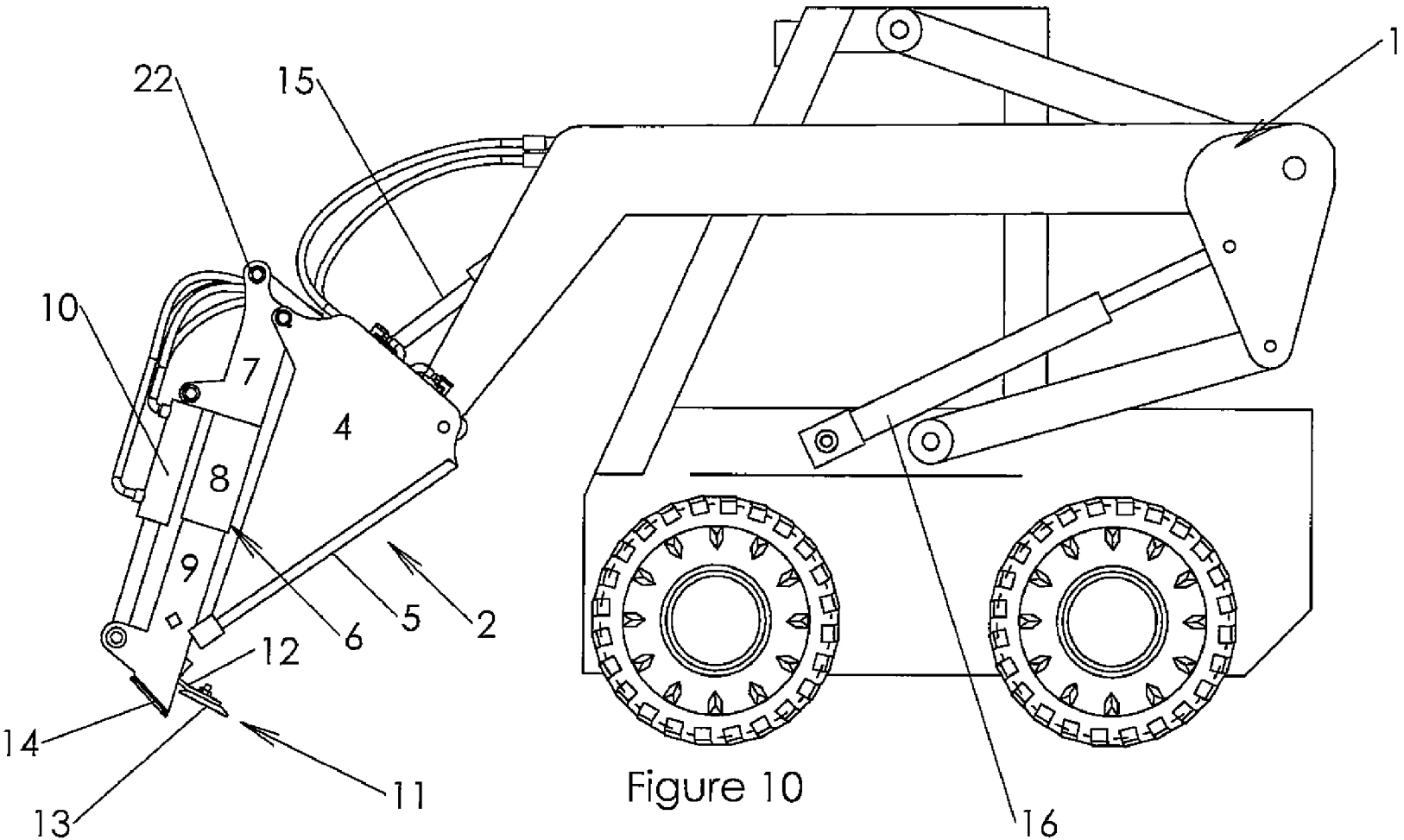
FIG. 10 is a side view of the present invention installed on the front of a skid loader with the elongated blade fully lowered and the bucket raised and tipped.

FIG. 10 illustrates the action of the third and fourth hydraulic cylinders 15, 16. In this figure, the elongated blade 11 is in the same position relative to the bucket 2 as in FIG. 9; however, the entire bucket has been lifted by the fourth hydraulic cylinders 16, and the bucket has been tipped by the third hydraulic cylinders 15. In this position, the present invention can be used for digging and/or grading.

Figure 11:
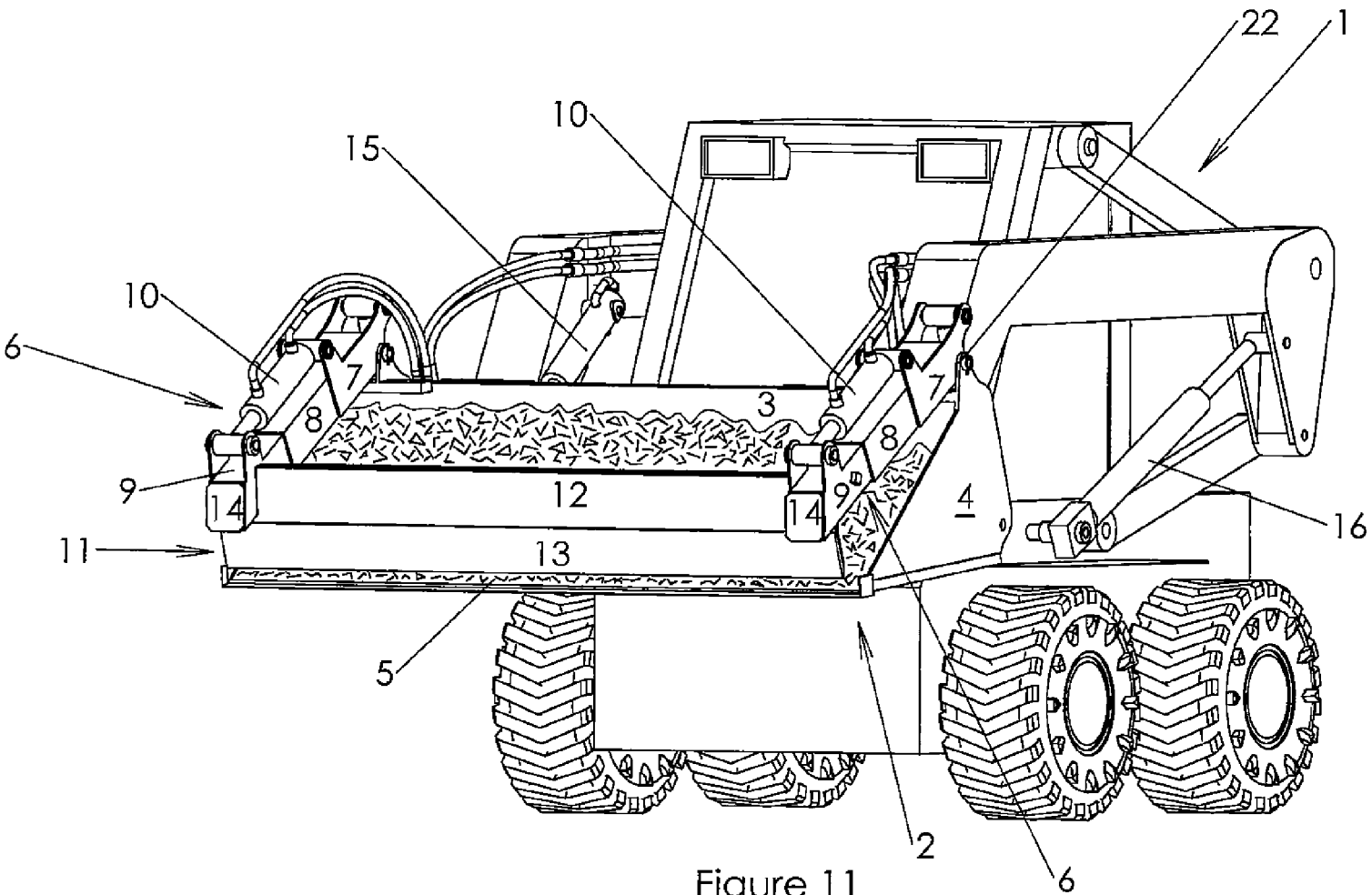
FIG. 11 is a perspective view of the present invention installed on the front of a skid loader with the bucket in the air and the elongated blade lifted slightly to allow gravel to flow out of the bucket at a controlled rate.

FIG. 11 is a perspective view of the present invention installed on the front of a skid loader with the bucket in the air and the elongated blade lifted slightly to allow gravel to flow out of the bucket at a controlled rate. This position might be used when it is desirable to distribute gravel more evenly than would otherwise be possible without the present invention. The positions shown in FIGS. 3 and 6-11 are illustrative only and are not intended to cover the myriad positions in which the present invention can be used.

Figure 12:
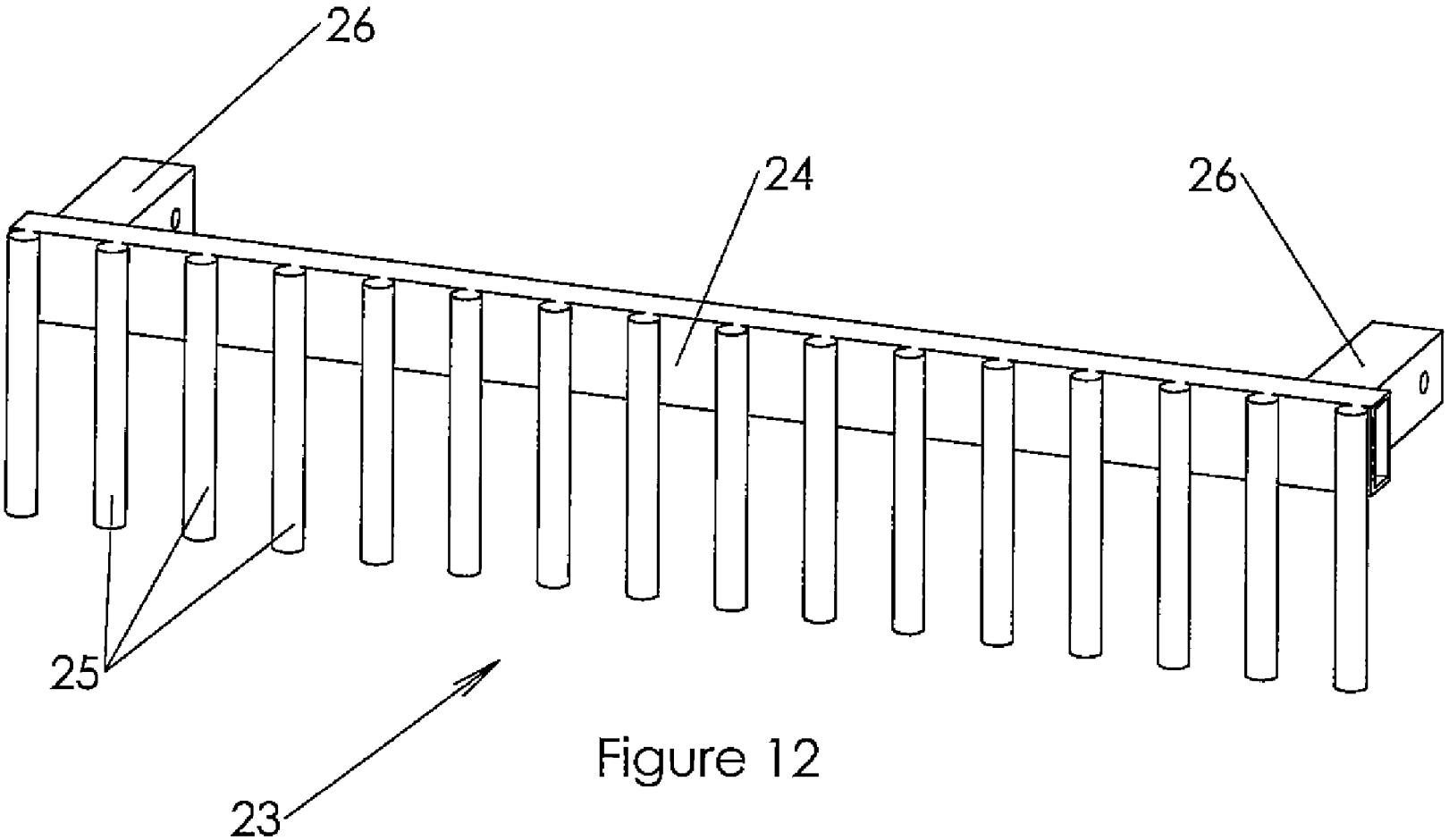
FIG. 12 is a perspective view of the present invention installed on the front of a skid loader with the rock rake attachment.
Figure 13:
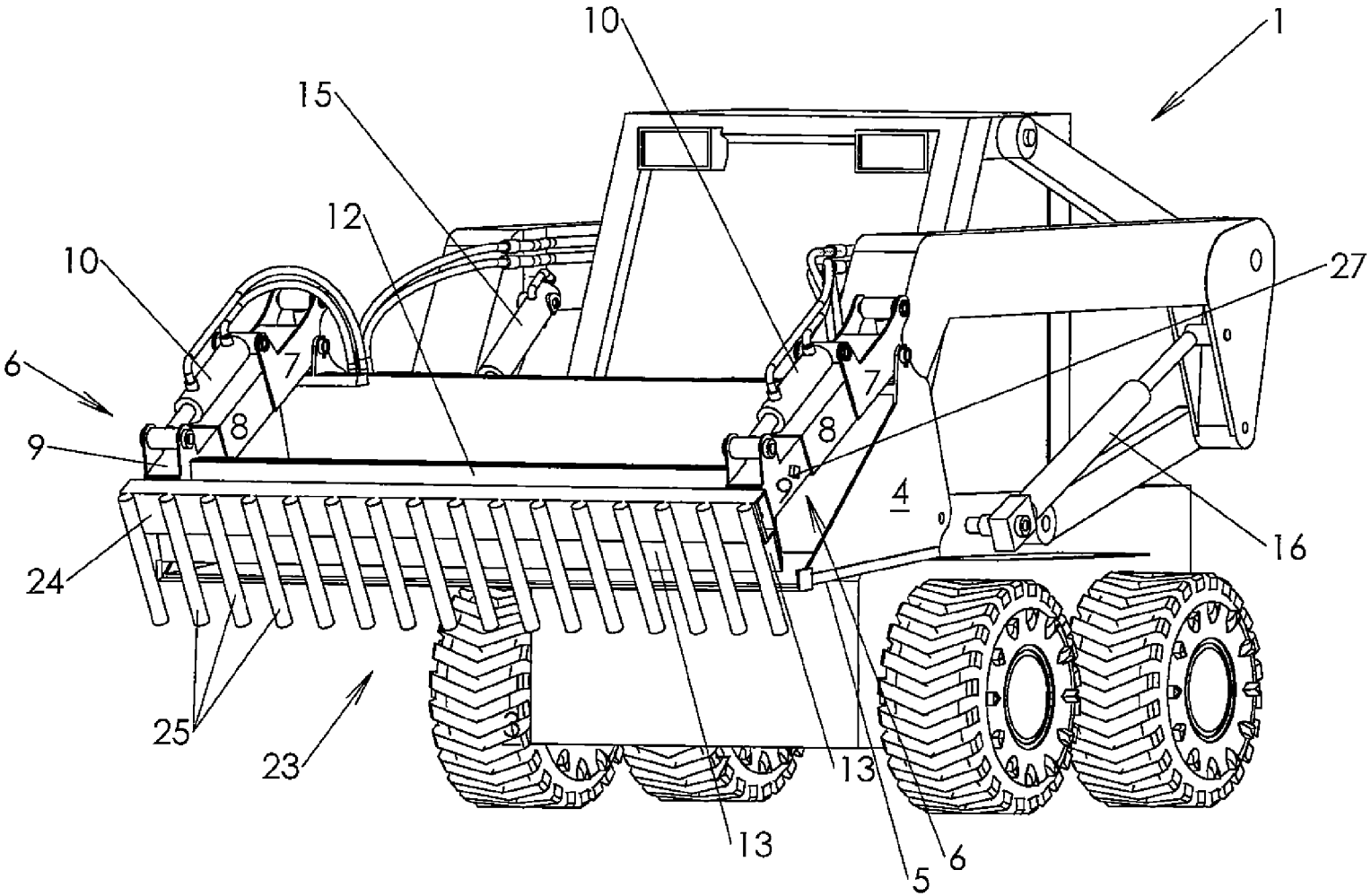
FIG. 13 is a perspective view of the rock rake attachment of the present invention.

FIG. 12 is a perspective view of the rock rake attachment standing alone, and FIG. 13 is a perspective view of the present invention installed on the front of a skid loader with the rock rake attachment 23. As shown in FIG. 12, the rock rake attachment 23 is comprised of a single lateral beam 24 to which a plurality of vertical teeth 25 are attached. The teeth 25 are preferably evenly spaced and extend below the bottom tip of the elongated blade 11. Two insertion members 26 extend perpendicularly from the rear surface of the lateral beam 24 and are used to attach the rock rake attachment 23 to the side arms 6.

As shown in FIG. 13, the rock rake attachment 23 attaches to the front end of each of the side arms 6 and is situated directly in front of the elongated blade 11. To attach the rock rake attachment 23, the two end plates 14 are removed from the front end of the extension piece 9 of each side arm 6, and the insertion members 26 of the rock rake attachment 23 are inserted into the extension pieces 9 and secured in place with bolts 27. The rock rake attachment 23 can be used to scoop large rocks or other large objects into the bucket 2 while allowing smaller objects (like dirt or gravel) to escape.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A construction bucket comprising:

(a) a rear wall;

(b) two side walls;

(c) a bottom plate comprising a front edge;

(d) two side arms, each side arm comprising a first hydraulic cylinder, a metal tube and an extension, wherein the extension fits into the metal tube, wherein the metal tube is fixedly attached to a bracket that is pivotally attached to one of the two side walls at a pivot point, and wherein each side arm is positioned directly on top of one of the two side walls; and (e) an elongated blade that is attached to the extension of each side arm;

wherein the first hydraulic cylinders cause the extension to extend and retract within the metal tube, thereby causing the elongated blade to extend and retract in relation to the pivot point.

2. The construction bucket of claim 1, further comprising two second hydraulic cylinders;

wherein each side arm comprises two brackets that lie on either side of the metal tube;

wherein the brackets on either side of the metal tube are pivotally attached to one of the two side walls to form a pivot point; and wherein each second hydraulic cylinder is situated behind the rear wall and is connected to the two brackets that lie on either side of the metal tube such that when the second hydraulic cylinder extends and retracts, the side arm pivots at the pivot point, thereby causing the elongated blade to be raised or lowered in relation to the front edge of the bottom plate of the construction bucket.

3. The construction bucket of claim 2, wherein the elongated blade has a height, and the height of the elongated blade is such that when the side arms are fully lowered in relation to the front edge of the bottom plate of the construction bucket, the elongated blade extends beneath the bottom plate.

4. The construction bucket of claim 1, further comprising two cushion valves, wherein each cushion valve is located behind the rear wall adjacent to one of the second hydraulic cylinders, wherein hydraulic hoses for the first and second hydraulic cylinders emanate from the two cushion valves, and wherein the cushion valves provide a cushioning effect for the first and second hydraulic cylinders.

5. The construction bucket of claim 1, further comprising a rock rake attachment;

wherein the rock rake attachment comprises a lateral beam, a plurality of vertical teeth, and two insertion members that extend perpendicularly from the lateral beam; and wherein to fit the rock rake attachment onto the bucket, the two insertion members of the rock rake attachment are inserted into the extensions of the side arms and bolted in place.

* * * * *